US010451284B2

(12) United States Patent
Van Melick

(10) Patent No.: US 10,451,284 B2
(45) Date of Patent: Oct. 22, 2019

(54) GAS HEARTH

(71) Applicant: Kal-Fire Beheer B.V., Belfeld (NL)

(72) Inventor: Beijko Martijn Eli Van Melick, Tegelen (NL)

(73) Assignee: KAL-FIRE BEHEER B.V., Belfeld (NL)

( * ) Notice: Subject to any disclaimer, the term of this patent is extended or adjusted under 35 U.S.C. 154(b) by 188 days.

(21) Appl. No.: 15/647,642

(22) Filed: Jul. 12, 2017

(65) Prior Publication Data

US 2018/0017262 A1 Jan. 18, 2018

(30) Foreign Application Priority Data

Jul. 18, 2016 (NL) ..... 2017184

(51) Int. Cl.

| | |
|---|---|
| ***F24B 1/199*** | (2006.01) |
| ***F24B 1/197*** | (2006.01) |
| ***F23C 1/04*** | (2006.01) |
| ***F42B 4/24*** | (2006.01) |
| ***F24C 3/00*** | (2006.01) |

(52) U.S. Cl.

CPC ..... *F24B 1/199* (2013.01); *F23C 1/04* (2013.01); *F24B 1/197* (2013.01); *F24C 3/006* (2013.01); *F42B 4/24* (2013.01)

(58) Field of Classification Search

CPC ..... F24B 1/199; F24B 1/197; F24C 3/006; F24C 1/04; F24C 4/24

USPC ..... 126/152; 48/127.1

IPC ..... F24B 1/199,1/197; F23C 1/04; F42B 4/24

See application file for complete search history.

(56) References Cited

U.S. PATENT DOCUMENTS

| | | | | |
|---|---|---|---|---|
| 5,092,313 | A | 3/1992 | Blackburn et al. | |
| 6,006,742 | A * | 12/1999 | Jamieson | F23D 14/10 126/512 |
| 2004/0173204 | A1* | 9/2004 | Early | F24C 3/006 126/512 |
| 2005/0087185 | A1* | 4/2005 | Rumens | A61L 9/03 126/512 |
| 2009/0126241 | A1 | 5/2009 | Asofsky | |
| 2015/0184861 | A1* | 7/2015 | Zhu | F24B 7/00 126/21 A |

FOREIGN PATENT DOCUMENTS

| | | | | |
|---|---|---|---|---|
| CA | 2869690 | A1 * | 10/2013 | F24B 7/00 |
| CH | 674 770 | A5 | 7/1990 | |

(Continued)

OTHER PUBLICATIONS

European Patent Office Search Report dated Apr. 4, 2017 for NL 2017184.

*Primary Examiner* — Gregory L Huson
*Assistant Examiner* — Daniel E Namay
(74) *Attorney, Agent, or Firm* — Shumaker, Loop & Kendrick, LLP

(57) ABSTRACT

A gas hearth including a combustion chamber, a gas supplier for supplying combustible gas into the combustion chamber to a firebed simulator disposed in the combustion chamber, an ignitor for igniting the combustible gas in the combustion chamber, a flue-gas discharge duct connected to the combustion chamber for discharging combustion flue gases from the combustion chamber, and a metering means disposed in the combustion chamber for metering a pyrotechnical additive into the flames of the burning combustible gas during operation.

19 Claims, 8 Drawing Sheets

(56) References Cited

FOREIGN PATENT DOCUMENTS

| | | | | | |
|---|---|---|---|---|---|
| EP | 3273163 | B1 | * | 1/2019 | |
| WO | 0157447 | A1 | | 8/2001 | |
| WO | WO-2013149391 | A1 | * | 10/2013 | ..... F24B 7/00 |

* cited by examiner

GAS HEARTH

TECHNICAL FIELD AND BACKGROUND

The invention relates to a gas hearth including a combustion chamber, a gas supplier for supplying combustible gas into the combustion chamber to a firebed-simulator positioned in the combustion chamber, an ignitor for igniting the combustible gas in the combustion chamber and a flue-gas discharge duct connected to the combustion chamber for discharging combustion flue gases from the combustion chamber.

Various types of hearths, in particular decorative hearths, are known and can be used as built-in hearths or as hearth stoves. Such decorative hearths are suitable for burning gas, wood or other natural fuels. A decorative hearth which is known from, for example, from EP1659340A2, tries to produce a fire image which is as realistic as possible and is characterized by firebed-simulating means which are made up as imitation logs which are provided with lighting elements.

The lighting elements which are present in the imitation logs emit light which gives the impression that the imitation log is burning. However, such decorative hearths in which the fire image is only based on lighting elements do not give a realistic impression of a fire.

Other decorative hearths are known, wherein firebed-simulating means in the form of imitation logs positioned over a real firebed have been placed in the combustion chamber. This firebed is produced by means of gas supply means which extend into the combustion chamber and by means of which gas along and around the imitation logs is ignited. This creates the impression as if the imitation logs are actually burning. The combustible flue gases are then discharged via a flue-gas discharge duct which is connected to the combustion chamber.

However, the problem associated with these gas hearths is that a relatively high supply of gas is required to achieve a firebed or flame bed which is sufficiently large as to create a realistic impression of a fire. As a result thereof, a significant amount of heat and energy is lost. Since the primary aim of a decorative hearth is to imitate a firebed and thereby to create an impression of a fire, producing heat is a secondary aim, thus it is desirable for a gas hearth to have a gas and energy consumption which is as minimal as possible.

BRIEF SUMMARY OF THE INVENTION

It is therefore an object of the present invention to provide a gas hearth according to the abovementioned preamble that provides a realistic impression of a fire while using a minimal amount of natural fuel.

To this end, the gas hearth is provided with metering means arranged in the combustion chamber for metering a pyrotechnical additive into the flames of the burning combustible gas during operation. This makes it possible to produce an additional fire impression, for example, sparks which also occur with the burning of real wooden logs.

More specifically, the metering means includes a reservoir for the pyrotechnical additive which is provided with at least one metering opening, and furthermore at least one supply line which is connected to the metering opening and ends near the firebed simulator. To this end, it is possible to install the metering means elsewhere in the gas hearth and not necessarily in the combustion chamber, which is not desirable from an aesthetic and safety point of view.

According to a further aspect, the metering means includes at least one pump which is placed near the at least one metering opening for passing a certain amount of pyrotechnical additive through the supply line in the direction of the firebed simulator by means of a pressurized medium.

More particularly, the metering means includes a valve arranged for closing the at least one metering opening and for dispensing a certain amount of pyrotechnical additive from the reservoir and the metering means includes control means for actuating the valve and the pump, in particular, for sequentially actuating the valve and the pump. In this way, it is possible to add the pyrotechnical additive to the flame bed in a quick and safe manner by means of a simple actuation in order to produce an additional, more realistic impression of a fire.

In one aspect, the valve is a magnetic coil-actuated valve and the pump is a compressed air pump.

The metering means may be arranged under or above the firebed simulator.

In the latter embodiment, the reservoir can be attached to a shaft, and the metering means can include drive means for rotatably driving the shaft.

In one aspect, the drive means can be configured as a chain drive.

In a further embodiment, the reservoir can be provided with a filling opening which can be closed with a closure, which closure, in the embodiment wherein the metering means have been arranged under the firebed simulator means, forms part of the firebed simulator.

In particular, the reservoir can be configured to pass the pyrotechnical additive to the at least one metering opening. Thus, the metering means can require very little, if any, maintenance and the risk of failures and/or blockages is minimal.

In this case, the reservoir may be provided with one or more walls which run at an angle in the direction of the at least one metering opening.

Furthermore, the pyrotechnical additive may include granules, for example a pulverulent or granular material, in particular a carbon-containing additive.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

Figure 1:
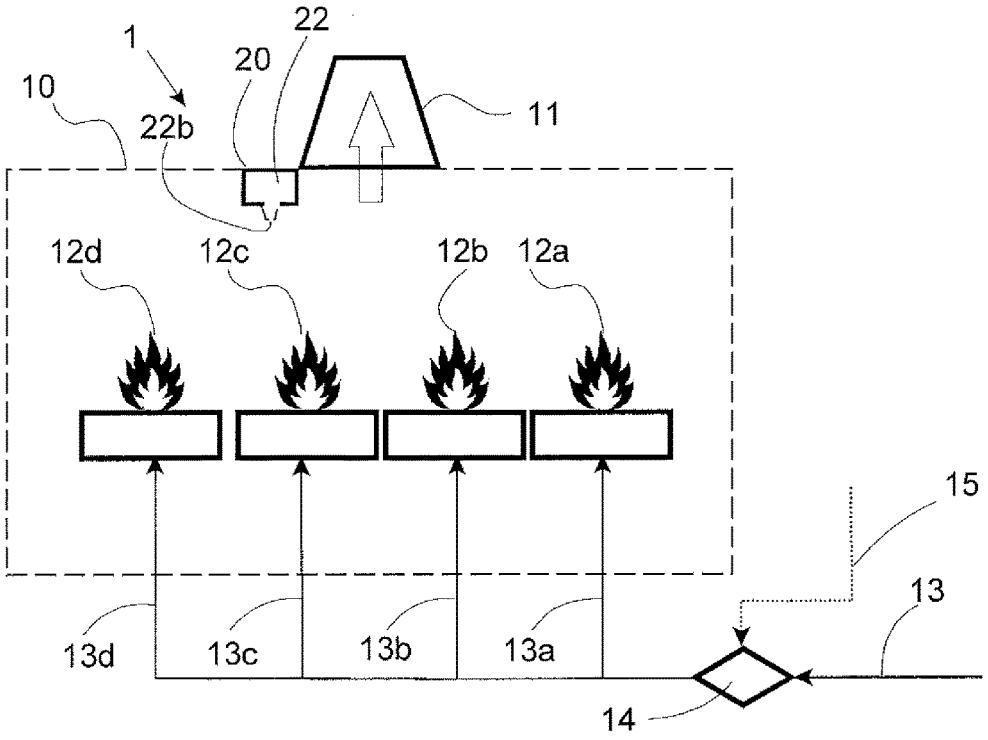
FIG. 1 shows a diagrammatic view of a gas hearth according to the prior art with a metering means according to the present invention.
Figure 2:
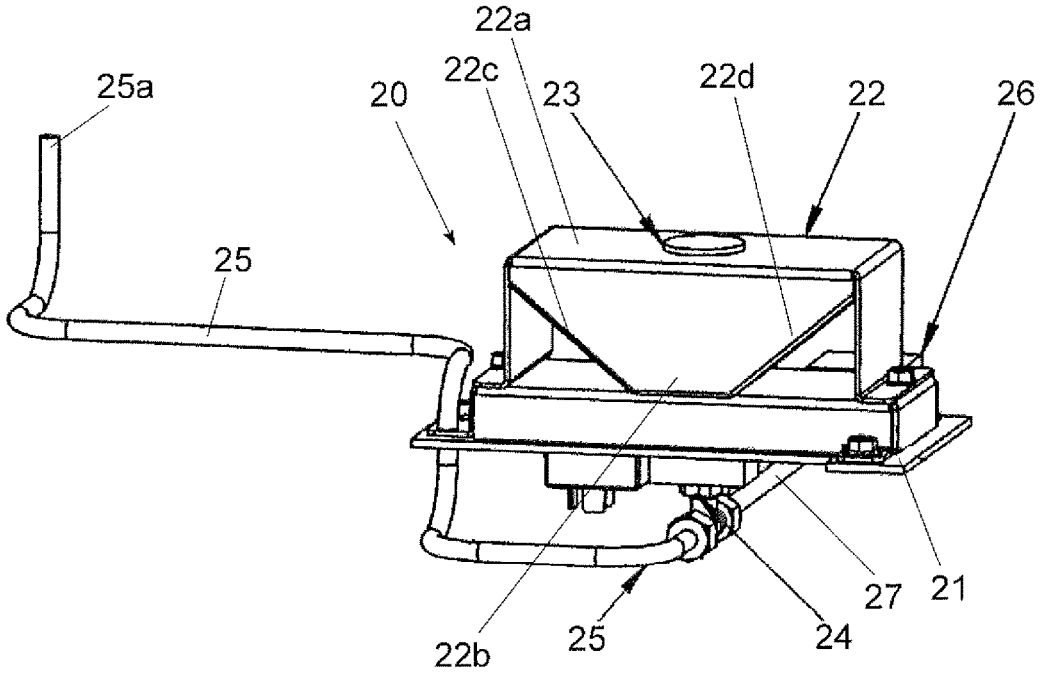
FIG. 2 is a perspective view of a metering means and hearth according to an embodiment of the invention.

For a better understanding of the invention, the similar components shown in the various figures are denoted by identical reference numerals in the following description of the figures.

FIG. 1 diagrammatically shows an embodiment of a gas hearth according to the prior art. In particular, the burner system of a hearth is shown in the way in which it is arranged in the combustion chamber of the gas hearth.

In general, a decorative hearth is composed of a housing comprising side walls, a bottom wall, a front wall and a rear wall. The front wall is often transparent and can also be rotated away or slid away for maintenance. The front, bottom, rear and side walls enclose a combustion chamber 10 in which the firebed-simulating means, denoted here, for example, by reference numerals 12*a*-12*d*, are accommodated. The firebed-simulating means 12*a*-12*d* are configured to simulate a fire image and all respective components are fitted to a bottom panel which forms part of the bottom wall of the combustion chamber 10.

As is illustrated in FIG. 1, the hearth 1 is provided with gas supply means (gas supply line) 13 which are connected to a main supply line (not shown). The gas supply line 13 branches off into branch lines 13*a*-13*d*, each of which extend into the combustion chamber 10, and which, in particular, each end at the location of the firebed-simulating means 12*a*-12*d*. A control valve 14 is incorporated in the gas supply line 13 which can be controlled by suitable control means (not shown) via the control line 15 and can be closed off in order to close off the gas supply into the combustion chamber 10.

The firebed-simulating means 12*a*-12*d* may be configured, for example, as imitation logs, which may, for example, be made of a fireproof ceramic material. Such imitation logs are often also porous, so that the gas supplied via the respective branch line 13*a*-13*d* may flow through or leak into the porous imitation logs and can be made to ignite locally on the surface using suitable, gas ignition means (not shown). In this way, a fire image may be simulated which is similar to that of a conventional fire of burning wooden logs.

The combustion flue gases can be discharged from the combustion chamber 10 via the flue-gas discharge duct 11.

As one objective of a decorative hearth is to produce a realistic fire image, and is not intended, unlike conventional hearths, to emit heat to the surroundings, it is desirable for a decorative hearth to produce as realistic a fire image as possible while using a minimal amount of gas.

However, a lower gas consumption (i.e. gas supply to the combustion chamber via the gas supply 13) also leads to fewer flames, as a result of which the fire image is less realistic. However, the firebed-simulating means 12*a*-12*d* aim to enhance the fire image by simulating burning logs.

In order to be able to also produce a realistic fire image with an improved fire impression in the case of reduced gas consumption, metering means 20 are arranged in the combustion chamber 10 which, during operation, meter a pyrotechnical additive into the flames of the burning combustible gas. In particular, the metering means are arranged above the firebed-simulating means 12*a*-12*d*, as is illustrated in FIG. 1, in such a way that, when metering the pyrotechnical additive being contained in reservoir 22 via the metering opening 22*b*, this additive ends up in the air stream of the rising combustible flue gases and is ignited by the flames when it flutters down in the direction of the firebed created by the firebed-simulating means 12*a*-12*d*. Upon ignition, the pyrotechnical additive generates additional fire and light effects, such as sparks, which also occur during burning of natural wooden logs.

Figure 5:
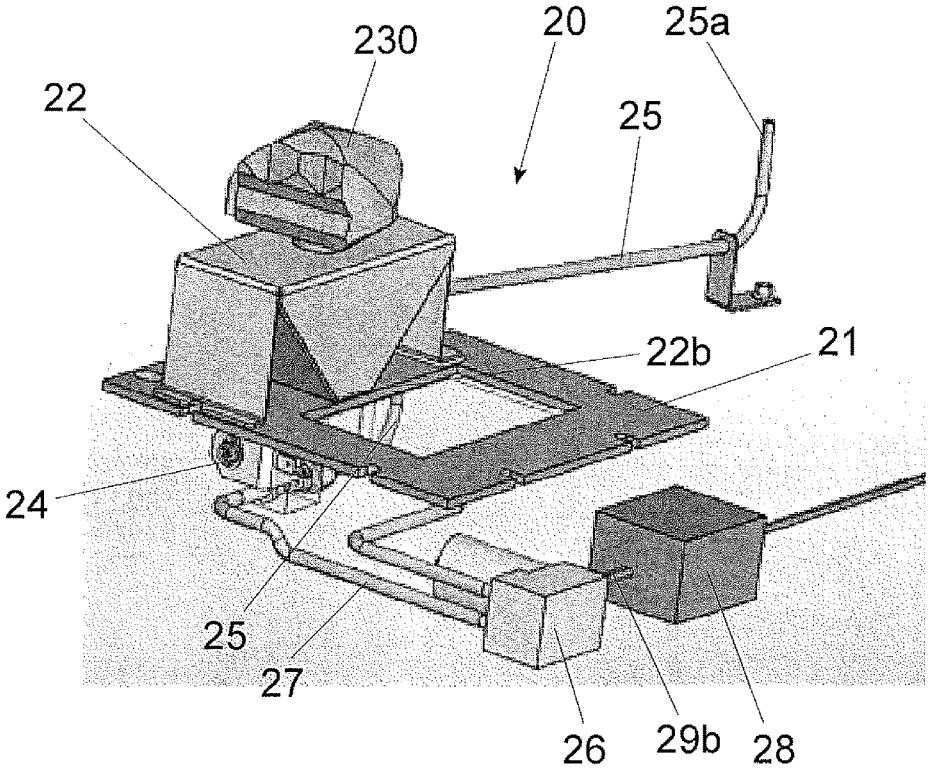
FIG. 5 is a perspective view showing the metering means, pump, and controller.

In another embodiment, such as illustrated, for example, in FIG. 5, the metering means 20 are arranged at the bottom of the combustion chamber 10 and more particularly under the firebed-simulating means 12*a*-12*d*.

The metering means 20 are composed of a mounting panel 21 to which, and on which, all relevant components are attached. Reference numeral 22 indicates a reservoir wherein a certain amount of pyrotechnical additive is stored. The reservoir 22 is sufficiently fire-resistant and heat-resistant in order to ensure that the heat which is produced in the combustion chamber during operation does not result in an undesirable and premature spontaneous combustion of the pyrotechnical additive which is held in the reservoir 22.

The reservoir 22 is provided with a top side 22*a* which is provided with an opening which may be closed off by a closure, in particular a closing lid 23. The reservoir 22 can be filled with a certain amount of pyrotechnical additive via the opening which is provided in the top side 22*a*. Furthermore, the reservoir 22 is provided with a metering opening 22*b* for supplying a certain amount of pyrotechnical additive from the reservoir 22 to a supply line 25 which runs from the metering opening 22*b* through the combustion chamber and the free end 25*a* of which ends at one of the firebed-simulating means 12*a*-12*d*, as is illustrated in FIG. 1.

The reservoir 22 is constructed in such a way that it promotes or facilitates the supply of the pyrotechnical additive from the reservoir 22 in the direction of the metering opening 22*b* and the supply line 25. In particular, the reservoir 22 is provided with oblique walls 22*c* and 22*d* which thus form a funnel in the direction of the metering opening 22*b*.

According to the invention, the metering opening 22*b* can be closed off by means of a controllable shut-off valve 24. By briefly opening and closing the closable valve 24, a certain amount of pyrotechnical additive can leave the reservoir 22 via the metering opening 22*b* closed off by the valve 24 and be received in the line 25. At the location of the closable valve 24, the line 25 is connected to an air line 27 which is connected to a pump 26. By means of the pump 26, the amount of pyrotechnical additive held in the line 25 by means of a pressurized medium, for example air, can be blown in the direction of the outlet opening 25*a*.

When the pyrotechnical additive leaves the outlet opening 25*a*, which, as has already been mentioned, is positioned at the location of the firebed-simulating means 12*a*-12*d*, it will come into contact with the burning gas and thus create additional flame and fire effects, such as sparks.

Figure 3:
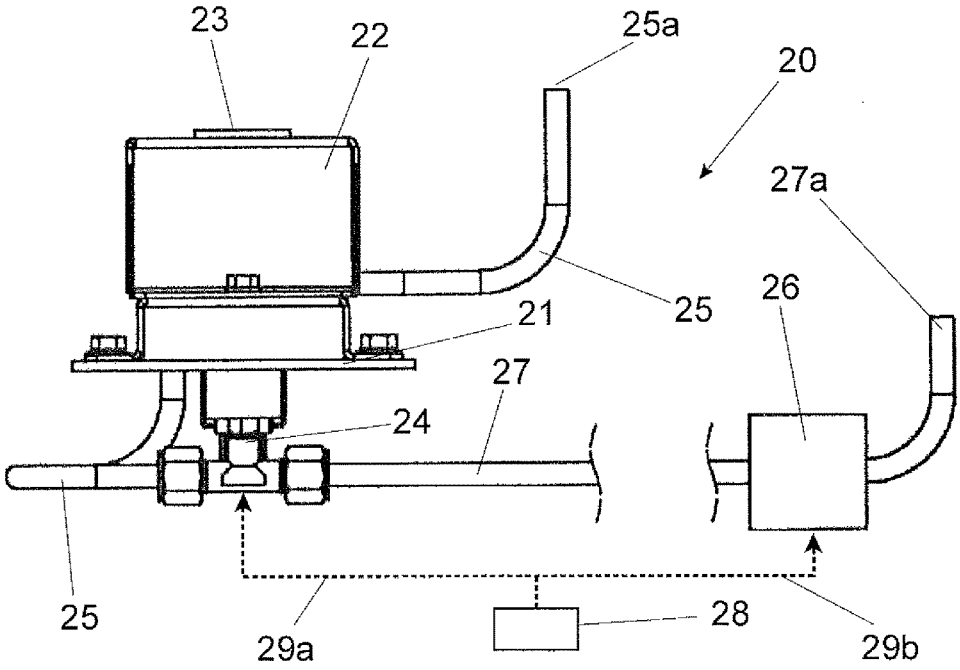
FIG. 3 is an elevation view of the metering means.

To this end, the metering means 20 also comprise control means 28 (see FIG. 3) which pass control signals to the closable control valve 24 or the pump 26, respectively, via suitable control lines 29*a* and 29*b*. More specifically, the control means 28 are configured in such a way that the control means actuate the control valve 24 and the air pump 26 sequentially. Sequentially means firstly that the closable control valve 24 is actuated by the control means 28, resulting in the control valve 24 being opened briefly. As a result thereof, a certain amount of pyrotechnical additive can be poured or metered into the line 25 from the reservoir 22 via the metering opening 22*b* which has been opened in this way.

Subsequently, the control valve 24 is closed by the control means 28 and the air pump 26 is actuated which blows this metered amount of pyrotechnical material through the supply line 25 in the direction of the outlet opening 25*a* by means of a short air pressure pulse via the air line 27 and the supply line 25. Upon leaving the outlet opening 25*a* on account of the air pulse delivered by the pump 26, the dispensed pyrotechnical additive will be brought to ignition at the location of the firebed-simulating means 12*a*-12*d* (see FIG. 1) by the burning gas and thus produce the additional flame and fire effects.

The air pump 26 is in each case actuated briefly by the control means 28 for delivering an air pressure pulse in the air line 27 in the direction of the control valve 24 and the supply line 25. To this end, the air pump 26 takes air from elsewhere and preferably from outside the combustion chamber 10 (see FIG. 1) via the inlet opening 27*a*. Thus, the air line 27 has such a length, as a result of which the air pump 26 and preferably the inlet opening 27*a* are arranged at some distance from and outside the combustion chamber 10. This prevents hot combustion flue gases from being introduced into the air line 27 via the inlet opening 27*a*, which could possibly cause the pyrotechnical additive metered into the supply line 25 to ignite spontaneously. The position of the inlet opening 27*a* of the air line 27 as far as outside the combustion chamber 10 is thus a safety aspect of the present gas hearth.

In this embodiment, a non-return valve has to be incorporated in the inlet line 27*a* which extends to the outside of the combustion chamber in order to prevent combustion flue gases from escaping from the combustion chamber 10 via the air line 27 and the inlet opening 27*a* instead of via the flue-gas discharge duct 11.

In a preferred embodiment, the inlet opening 27*a* of the air line 27 and the outlet opening 25*a* of the outlet line 25 are both in the combustion chamber 10. This results in a closed system, so that combustion flue gases cannot escape from the combustion chamber except via the flue-gas discharge duct 11. However, the inlet opening 27*a* has to be arranged in the combustion chamber 10 in such a way, for example at some distance from the firebed-simulating means, so as to prevent an undesired inflow of combustion flue gases.

In yet another embodiment, the air pump is not switched on or off by the control means 28, but the air pump is actuated continuously and an air stream is continuously blown in the direction of the supply line 25 and the outlet line 25*a* by the air line 27.

Figure 4:
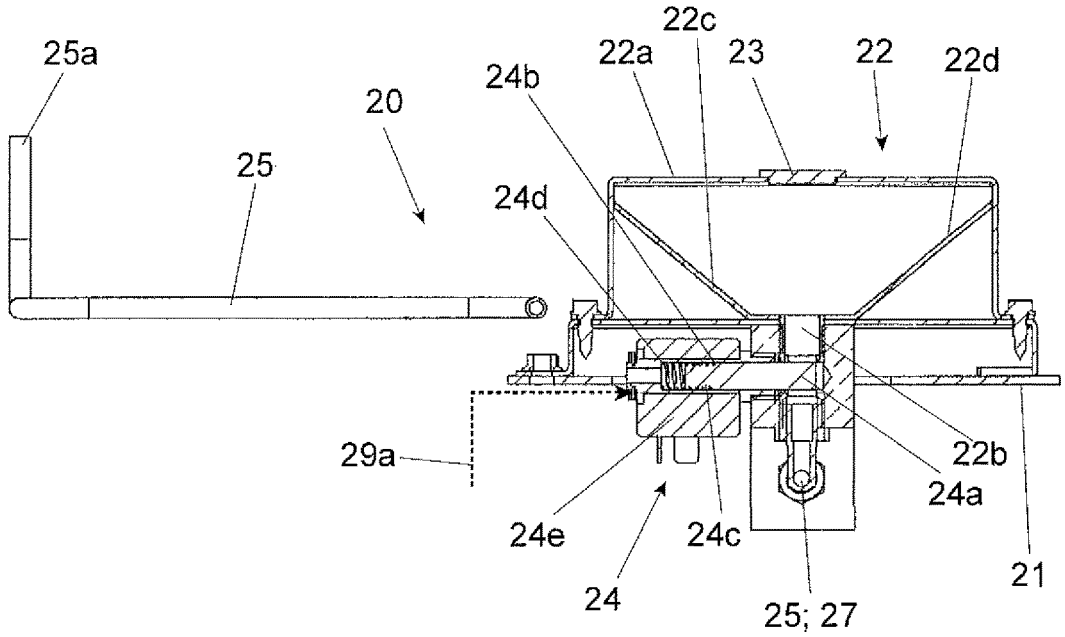
FIG. 4 is a cross-sectional view of the metering means.

As is illustrated in FIG. 4, the closable control valve 24 is, in particular, a magnetic valve (also referred to as a magnet-coil actuated valve). To this end, the control valve 24 is provided with a bore hole 24*b* in which a reciprocating plunger 24*a* is accommodated. The plunger 24*a* is movable into a closed position, such as illustrated in FIG. 4, in which it closes the metering opening 22*b* and closes it off from the air line 27 and the supply line 25, and into an open position, in which the metering opening 22*b* is briefly connected with the supply line 25, so that pyrotechnical additive which is situated in the reservoir 22 can be metered out.

The reciprocating plunger 24*a* is provided with grooves 24*d* wherein coil windings 24*c* are wound. In addition, the valve 24 is provided with a magnet 24*e* which is arranged around the bore hole 24*b* and the part of the plunger 24*a* where the coil windings 24*c* are situated. By means of suitable control signals which are emitted by the control means 28 to the magnetic valve 24 via the control line 29*a*, the plunder 24*a* can be moved to and fro in the bore hole 24*b* between the closed position and the open position on account of the coil/magnet interaction.

In this way, it is possible to transfer a small amount of pyrotechnical additive from the reservoir and the open metering opening 22*b* to the supply line 25 by in each case briefly opening the magnetic valve 24. Closing the magnetic valve 24 again first and then actuating the air pump 28 to deliver an air pulse into the air line 27 prevents the air pulse from blowing the pyrotechnical additive which has just been metered back into the reservoir 22. By contrast, the closed magnetic valve 24 causes the metered pyrotechnical additive which is present in the supply line 25 to be blown in the direction of the outlet opening 25*a* by the air pulse through the supply line 25.

Preferably, the actuation of the magnetic valve 24 by the control means 28 is random, so that the supply of the pyrotechnical additive via the outlet opening 25*a* to the burning firebed-simulating means 12*a*-12*d* is also random and unpredictable. The random unpredictable actuation of the magnetic valve 24 and the resulting random supply of pyrotechnical additive to the firebed-simulating means 12*a*-12*d* also contributes to a more realistic fire image, since this also produces random flame and fire effects, similar to the fire image of a conventional burning log fire.

The time period of the brief opening of the magnetic valve 24 may also be set randomly within a certain range, so that the amount of pyrotechnical additive during each metering from the reservoir 22 in the supply line 25 also varies. Consequently, the intensity of the resulting flame and fire effects vary with each dose. This also helps to create an improved simulation of the random and chaotic fire image of a conventional burning log fire.

The pyrotechnical additive preferably includes granules, in particular a pulverulent or granular material. In particular, the pyrotechnical additive is a carbon-containing additive, in which the granules have a grain size of between 0.05 mm-2.5 mm.

In a further embodiment, such as illustrated in FIG. 5, wherein the metering means 20 are positioned under the firebed-simulating means 12*a*-12*d* of the gas hearth, as is illustrated in FIG. 1, the closure 23 is formed in such a manner that it forms part of the firebed-stimulating means. In FIG. 5, the closure is denoted by reference numeral 230 and is formed as an imitation log. In this way, the metering means 20 can be fitted at a small distance below the level of the firebed-simulating means 12*a*-12*d* in the gas hearth, thus achieving a further reduction in the installation space.

It should be noted that although the sealing cap 230 is formed as an imitation log, it does not actively contribute to the play of flames and fire during operation. The sealing cap 230 will therefore not be porous and will also not be provided with a connection to the gas supply means 13, as illustrated in FIG. 1.

Figure 6:
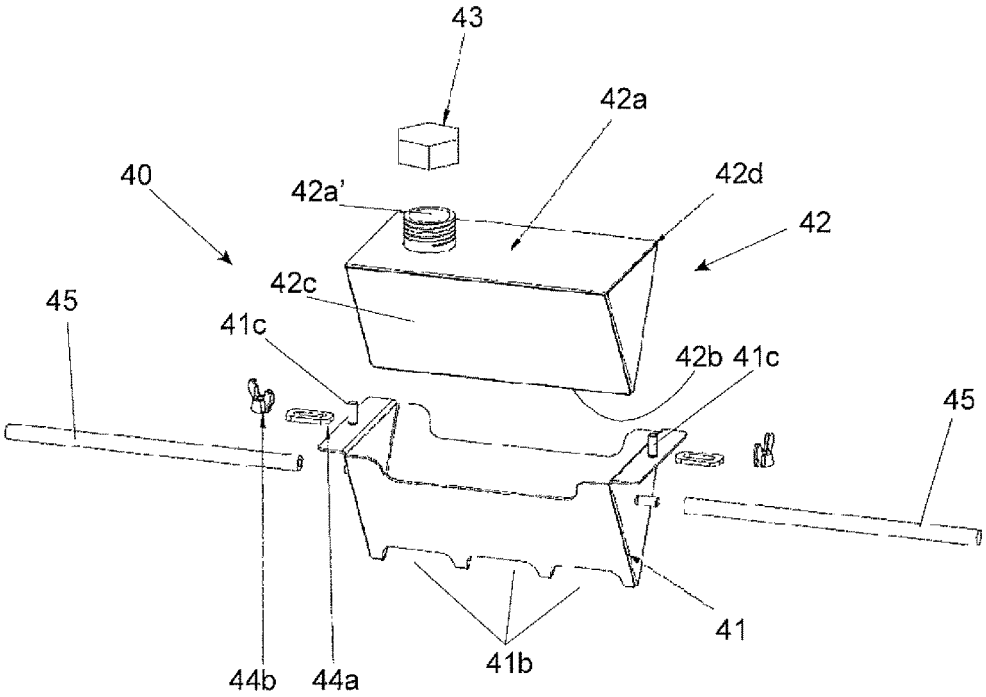
FIG. 6 is an exploded view of another embodiment of a metering means.
Figure 7:
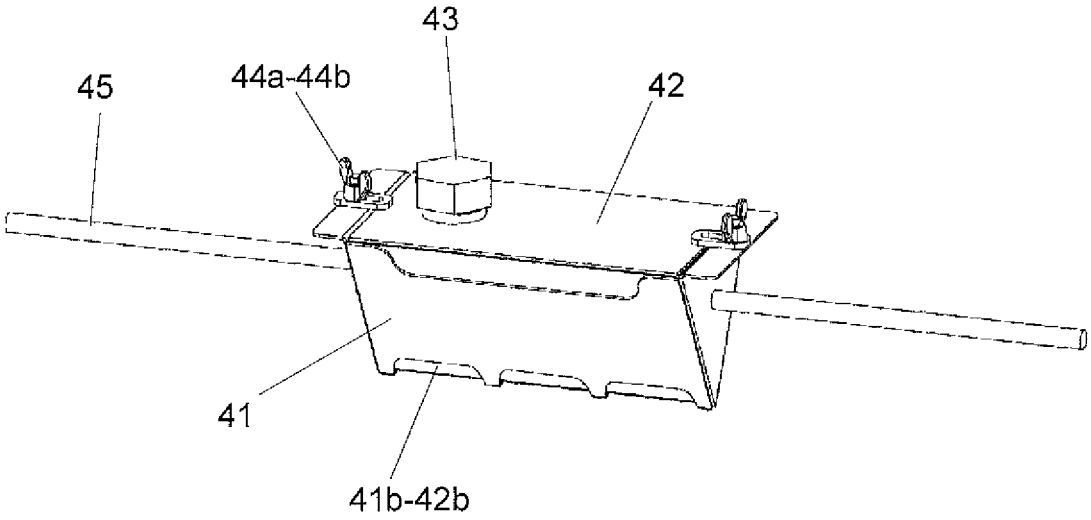
FIG. 7 is an assembled perspective view of the metering means of FIG. 6.
Figure 8:
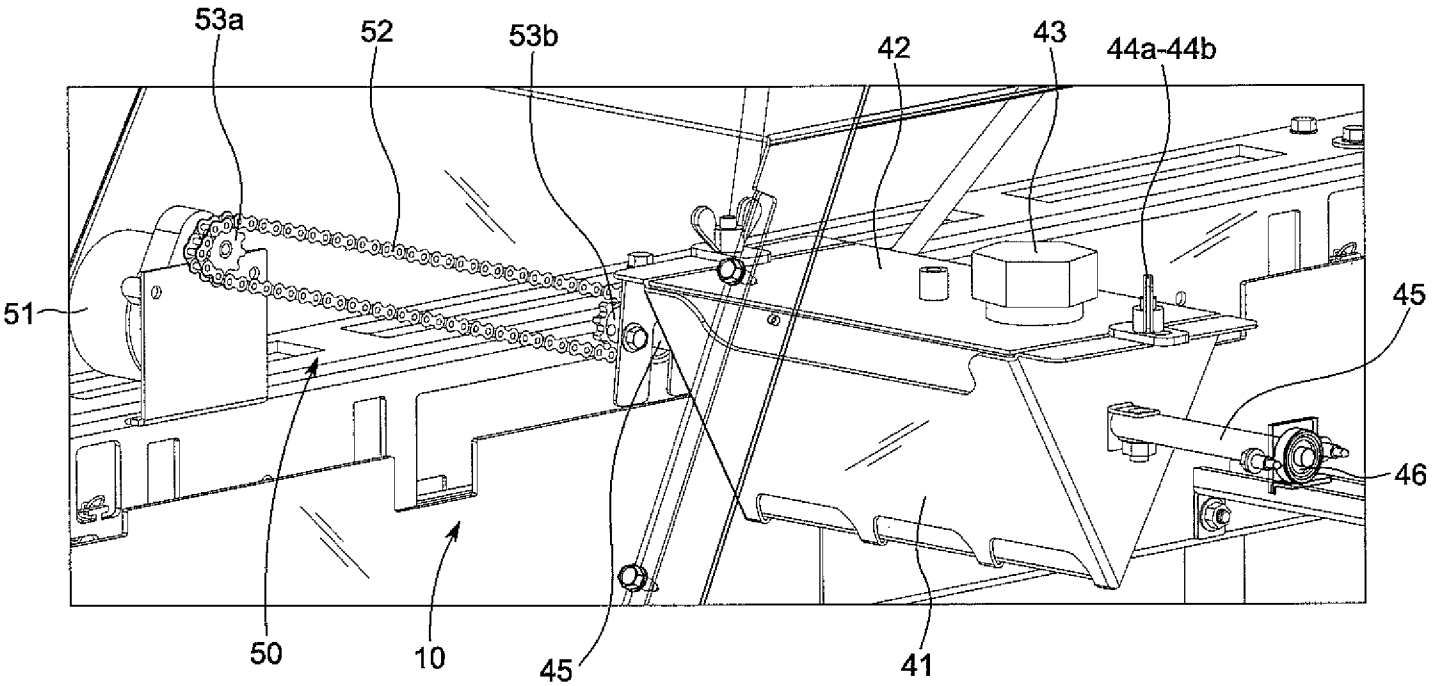
FIG. 8 is a detailed view of a portion of the hearth according to an embodiment of the invention.

FIGS. 6-8 show another embodiment of a gas hearth according to the invention.

In this embodiment, the metering means 40 are positioned at the top of the combustion chamber 10 and in particular above the firebed-simulating means 12*a*-12*d*. The reservoir 42 is provided with a top side 42*a* in which an opening 42*a*' is provided which can be closed off by a closure, in particular a closing lid or cap 43. The reservoir 42 can be filled with a certain amount of pyrotechnical additive via the opening 42*a*' which is provided in the top side 42*a*.

Furthermore, the reservoir 42 is provided with one or more metering openings 42*b* for supplying or scattering a certain amount of pyrotechnical additive at the top of the combustion chamber 10 (and above the burning firebed-simulating means 12*a*-12*d*) from the reservoir 42. In this case, the reservoir 42 is placeable in a holder 41 which is supported by shafts 45 which are rotatably accommodated in the combustion chamber 10 (see FIG. 8). In this case, reservoir 42 is retained in the holder 41 by means of a retaining pawl 44*a* which can be fixed to the threaded end 41*c* of the holder 41 by means of a swivel or screw 44*b*.

Analogous to the reservoir 22 as shown in FIGS. 2-6, the reservoir 42 has oblique walls 42*c* and 42*d* which thus form a funnel in the direction of the metering opening 42*b* in order thus to assist or facilitate the supply of the pyrotechnical additive to the combustion chamber 10.

Furthermore, the metering means 40 comprise drive means 50 for rotatably driving the shaft 45. The drive means 50 are placed on one side of the combustion chamber 10 and in this embodiment comprise a drive motor 51 (electric motor) provided with a first gear wheel 53*a* by means of which the shaft 45 is rotatably driven via a chain transmission. To this end, a chain 52 is placed over the first gear wheel 53*a* and also runs across a second gear wheel 53*b*. The second gear wheel 53*b* is placed on the shaft 45. On the other side of the combustion chamber 10, the shaft 45 is mounted in a bearing 46 which is accommodated in the wall of the combustion chamber 10.

In operation, the drive motor 51 will rotate the shaft 45, as a result of which the holder 41 with the reservoir 42 in the combustion chamber 10 and above the firebed-simulating means 12*a*-12*d* co-rotate. With each rotation, the pyrotechnical additive in the reservoir 42 will be displaced in the direction of the metering opening(s) 42*b* (partly assisted by the oblique side walls 42*c* and 42*d*) and will be released into the top of the combustion chamber 10 and above the burning firebed-simulating means 12*a*-12*d* (see FIG. 1) via the metering opening(s) 41*b*/42*b* on account of the force of gravity.

The pyrotechnical additive will enter the air stream of the rising combustible flue gases and will be ignited by the flames when it drifts down in the direction of the firebed created by the firebed-simulating means 12*a*-12*d*. Upon ignition, the pyrotechnical additive creates additional fire and light effects, such as sparks, which also occur during burning of natural wooden logs.

Instead of performing a complete rotation, the reservoir 42 may also be rotated to and fro by the drive motor 51. Upon each rotation or reciprocating movement, the pyrotechnical additive in the reservoir 42 will be disturbed and will be released in the form of a small dose of a random amount of additive via the metering opening 42*b* (and 41*b*).

What is claimed is:

1. A gas hearth, comprising:

a combustion chamber;

a gas supply for supplying combustible gas into the combustion chamber to a firebed simulator positioned in the combustion chamber;

an ignitor for igniting the combustible gas in the combustion chamber;

a flue-gas discharge duct connected to the combustion chamber for discharging combustion flue gases from the combustion chamber; and metering means arranged in the combustion chamber for metering a pyrotechnical additive into flames of burning combustible gas during operation.

2. The gas hearth according to claim 1, wherein the metering means comprises a reservoir for holding the pyrotechnical additive, wherein the reservoir has at least one metering opening.

3. The gas hearth according to claim 2, wherein the metering means comprises at least one supply line connected to the metering opening and ending near the firebed simulator.

4. The gas hearth according to claim 2, wherein the metering means comprises at least one pump disposed near the at least one metering opening for passing a predetermined amount of pyrotechnical additive through the supply line in a direction of the firebed simulator by way of a pressurized medium.

5. The gas hearth according to claim 4, wherein the metering means comprises a valve for closing the at least one metering opening.

6. The gas hearth according to claim 5, wherein the metering means comprises a controller for sequentially actuating the valve and the at least one pump.

7. The gas hearth according to claim 5, wherein the valve is a magnet coil-actuated valve.

8. The gas hearth according to claim 4, wherein the at least one pump is a compressed air pump.

9. The gas hearth according to claim 2, wherein the reservoir is attached to a shaft.

10. The gas hearth according to claim 9, wherein the metering means comprises drive means for rotatably driving the shaft.

11. The gas hearth according to claim 10, wherein the drive means is a chain drive.

12. The gas hearth according to claim 2, wherein the reservoir has a filling opening configured to be closed with a closure.

13. The gas hearth according to claim 12, wherein the closure forms part of the firebed simulator.

14. The gas hearth according to claim 2, wherein the reservoir is configured to pass the pyrotechnical additive to the at least one metering opening.

15. The gas hearth according to claim 2, wherein the reservoir has one or more walls oriented at an angle in a direction of the at least one metering opening.

16. The gas hearth according to claim 1, wherein the metering means is arranged below the firebed simulator.

17. The gas hearth according to claim 1, wherein the metering means is arranged above the firebed simulator.

18. The gas hearth according to claim 1, wherein the pyrotechnical additive comprises granules including a carbon-containing additive.

19. The gas hearth according to claim 1, wherein the granules are a pulverulent or granular material.

* * * * *